US007661418B2

(12) United States Patent
Bednar et al.

(10) Patent No.: US 7,661,418 B2
(45) Date of Patent: Feb. 16, 2010

(54) CROSSBOW GRIP GUARD

(76) Inventors: Richard L. Bednar, 429 Buttevant Dr., Munroe Falls, OH (US) 44262-1742; Michael J. Shaffer, 144 Joel Dr., Mogadore, OH (US) 44260

( * ) Notice: Subject to any disclaimer, the term of this patent is extended or adjusted under 35 U.S.C. 154(b) by 375 days.

(21) Appl. No.: 11/489,773

(22) Filed: Jul. 20, 2006

(65) Prior Publication Data

US 2007/0028907 A1 Feb. 8, 2007

Related U.S. Application Data

(60) Provisional application No. 60/700,876, filed on Jul. 20, 2005.

(51) Int. Cl.
*F41B 5/12* (2006.01)

(52) U.S. Cl. ..... 124/25

(58) Field of Classification Search ..... 124/25, 124/86, 88

See application file for complete search history.

(56) References Cited

U.S. PATENT DOCUMENTS

| | | | | |
|---|---|---|---|---|
| 859,932 | A | 7/1907 | Edwards | |
| 1,037,486 | A | 9/1912 | Johnson | |
| 2,312,150 | A | 2/1943 | Conner | |
| 2,674,822 | A | 4/1954 | Studler | |
| 2,965,994 | A | 12/1960 | Sullivan | |
| 2,981,154 | A | 4/1961 | Sweeney | |
| 3,090,150 | A | 5/1963 | Stoner | |
| 3,242,917 | A * | 3/1966 | Benedict | 124/25 |
| 3,641,691 | A | 2/1972 | Ellis at al. | |
| 4,258,689 | A * | 3/1981 | Barnett | 124/25 |
| 4,536,982 | A | 8/1985 | Bredbury et al. | |
| 4,663,875 | A | 5/1987 | Tatro | |
| 4,733,489 | A | 3/1988 | Kurak | |
| D300,161 | S | 3/1989 | Baldus et al. | |
| 5,010,676 | A | 4/1991 | Kennedy | |
| 5,103,714 | A | 4/1992 | LaFrance | |
| 5,198,600 | A | 3/1993 | E'Nama | |
| 5,343,650 | A | 9/1994 | Swan | |
| 5,590,484 | A | 1/1997 | Mooney et al. | |
| 5,630,405 | A * | 5/1997 | Nizov | 124/25 |
| 5,826,363 | A | 10/1998 | Olson | |
| 5,930,935 | A | 8/1999 | Griffin | |
| 6,134,823 | A | 10/2000 | Griffin | |
| 6,293,040 | B1 | 9/2001 | Luth | |
| 6,381,895 | B1 | 5/2002 | Keeney et al. | |
| 6,449,893 | B2 | 9/2002 | Spinner | |
| 6,609,321 | B2 | 8/2003 | Faifer | |
| D486,547 | S | 2/2004 | Faifer | |
| 6,705,304 | B1 * | 3/2004 | Pauluhn | 124/25 |
| 6,836,990 | B2 | 1/2005 | Shiloni | |
| 6,868,845 | B1 * | 3/2005 | Moore | 124/25 |

* cited by examiner

*Primary Examiner*—John Ricci
(74) *Attorney, Agent, or Firm*—Brouse McDowell

(57) ABSTRACT

A crossbow having a crossbow grip guard that has a member that extends outwardly in a direction that is substantially perpendicular to the longitudinal axis of the crossbow barrel or stock, and wherein the member extends for a length in a direction that is substantially parallel to the longitudinal axis of the crossbow barrel or stock.

2 Claims, 10 Drawing Sheets

CROSSBOW GRIP GUARD

This U.S. Utility patent application claims priority to U.S. Provisional patent application Ser. No. 60/700,876 entitled, "Crossbow Grip Guard," which was filed on Jul. 20, 2005.

I. BACKGROUND OF THE INVENTION

A. Field of Invention

This invention pertains to the art of methods and apparatuses for safely discharging a crossbow device. This invention more specifically pertains to a safety device that maintains the fingers of the operator in a safe position during discharge of the crossbow device. This invention also more specifically pertains to a crossbow grip guard that aids the operator in maintaining proper finger orientation and proper holding of a crossbow in aiming and discharging the crossbow.

B. Description of the Related Art

It is known in the art to draw back the bowstring for a crossbow device. Since crossbows propel the bolts there from with the force of the bowstring, a substantial bowstring force is needed to accurately target the intended game. As a result, during discharge of the crossbow the force is exerted on the projectile through the bowstring.

It is also known that during discharge of the cross bow and bowstring respectively certain associated operator's have placed a thumb or finger in the path of the moving bowstring, causing injury to the associated operator's appendage. What is needed is a device that maintains the appendages of the associated operator's hand that grasps the stock of the crossbow in a safe location during discharge of the crossbow and bowstring.

II. SUMMARY OF THE INVENTION

An embodiment is directed to a crossbow grip guard having a member that extends outwardly in a direction that is substantially perpendicular to the stock, and wherein the member extends for a length in a direction that is substantially parallel to the longitudinal axis of the crossbow barrel or stock.

Another embodiment of the present invention includes a crossbar having first and second ends, and a center portion fixedly connected to the stock at the center portion; a crossbow string operatively connected between the first and second ends of the crossbar; a crossbow trigger mechanism, the improvement comprising a crossbow grip guard having a member that extends outwardly in a direction that is substantially perpendicular to the stock, and wherein the member extends for a length in a direction that is substantially parallel to the longitudinal axis of the crossbow barrel or stock.

Yet another embodiment of the present invention includes a circular crossbow stock, wherein at least a cross-sectional portion of the stock that is perpendicular to the longitudinal axis of the crossbow barrel has an outer circumference length ranging from about 5 to about 8 inches.

Still another embodiment of the present invention includes an enlarged crossbow stock that aids in preventing injury to a user's hand during the discharge of the drawn-back crossbow bowstring.

Yet another embodiment of the present invention includes at least a means for preventing injury to a crossbow user's hand that is positioned on the crossbow stock during the discharge of the drawn-back crossbow bowstring.

An operator of a crossbow is helped to correctly grip the crossbow using a grip guard.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

IV. DESCRIPTION OF THE PREFERRED EMBODIMENT

Figure 1:
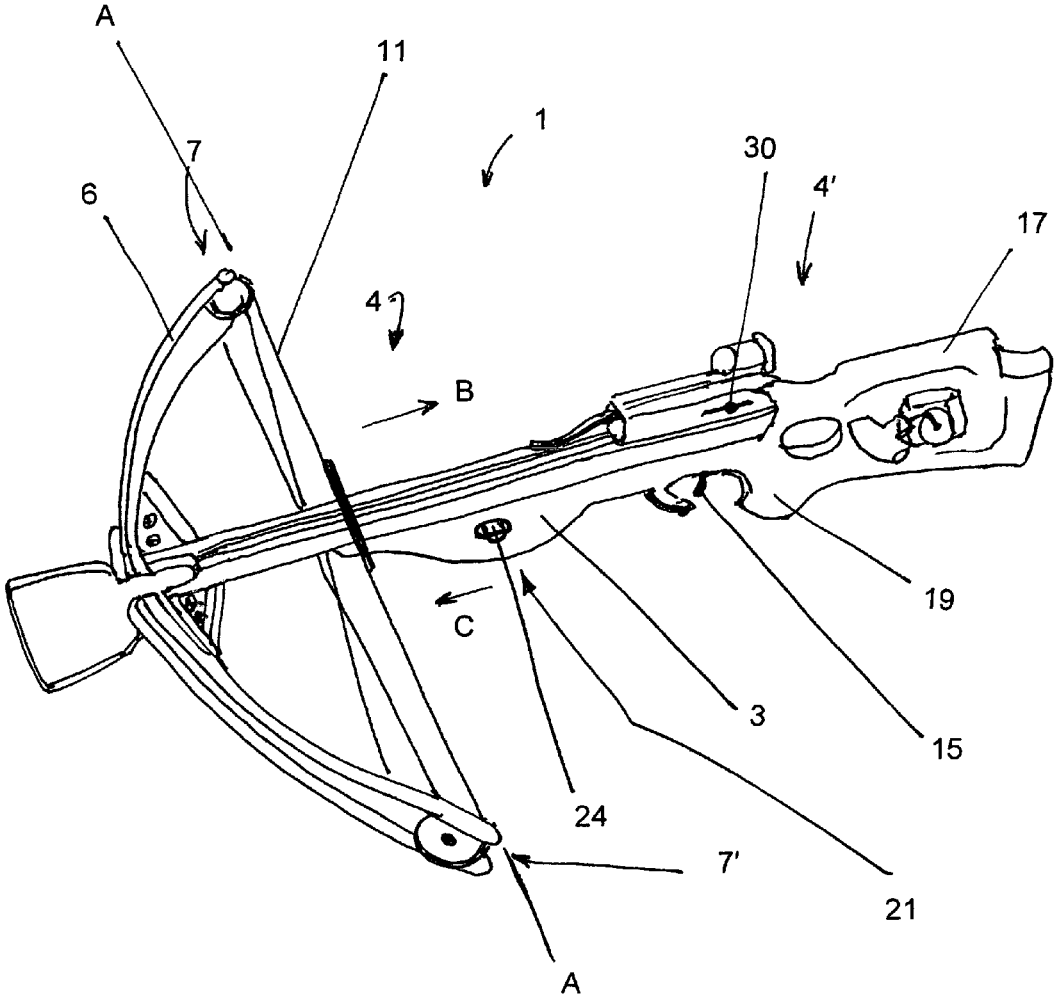
FIG. 1 is a picture of a crossbow having a stock safety device.

Referring now to the drawings wherein the showings are for purposes of illustrating an embodiment of the invention only and not for purposes of limiting the same, FIG. 1 shows a crossbow depicted generally at 1. The crossbow 1 may include a crossbow stock 3. The stock 3 may be generally longitudinal having first and second ends 4, 4' respectively. A crossbar 6 may be juxtaposed to the first end 4 of the stock 3 and fixedly connected thereto in a manner well known in the art. The crossbar 6 may include first and second ends 7, 7' that define an axis A that extends generally perpendicular to the longitudinal axis of the stock 3. The ends 7, 7' of the crossbar 6 may receive a bowstring 11 that extends between the ends 7, 7' of the crossbar 6 in a manner well known in the art. The crossbow 1 may be configured such that when the bowstring 11 is drawn back in a first direction B, the crossbar 6 may flex or bend storing potential energy in the device 1. The bowstring 11 may be secured in place by a trigger mechanism 15 having a crossbow string latch, not shown, that selectively holds the bowstring 11 until it is desired to release or discharge the crossbow 1. When an associated operator draws the crossbow string back the string 11 is received by the latch, not shown, and is held in place until the trigger mechanism 15 is released. Once the crossbow string 11 has been drawn back, an associated operator may place a projectile or bolt, not shown, onto the top portion of the stock 3 and fit a first end of the bolt over the bowstring 11. After such time, the trigger mechanism 15 may be engaged; releasing the force stored in the device 1 and propelling the projectile forward in a direction C.

Figure 2:
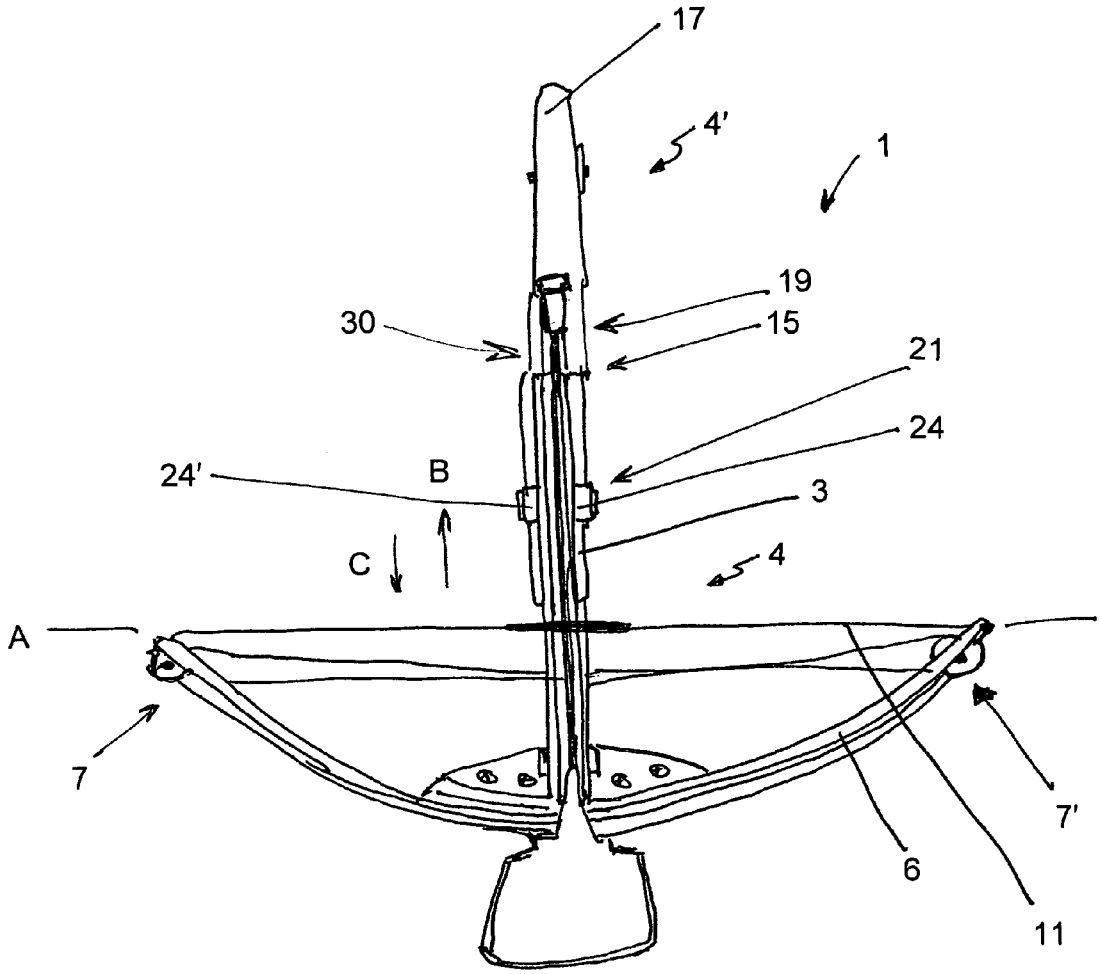
FIG. 2 is a picture of a crossbow having a stock safety device.

With reference now to FIGS. 1 and 2, the crossbow 1 may include a crossbow butt 17. The butt 17 of the crossbow 1 may be juxtaposed to the associated operator's shoulder during discharge of the device 1. A grip 19 may be fashioned in the stock 3 wherein the trigger mechanism 15 is installed proximate to the grip 19; toward the second end 4' of the stock 3. This allows the associated operator to securely grasp the crossbow 1 with a first hand during operation of the device 1. The other hand of the associated operator may grasp the stock 3 toward the first end 4 thereof. This allows the operator to firmly hold the crossbow 1 during operation and discharge.

Figure 3:
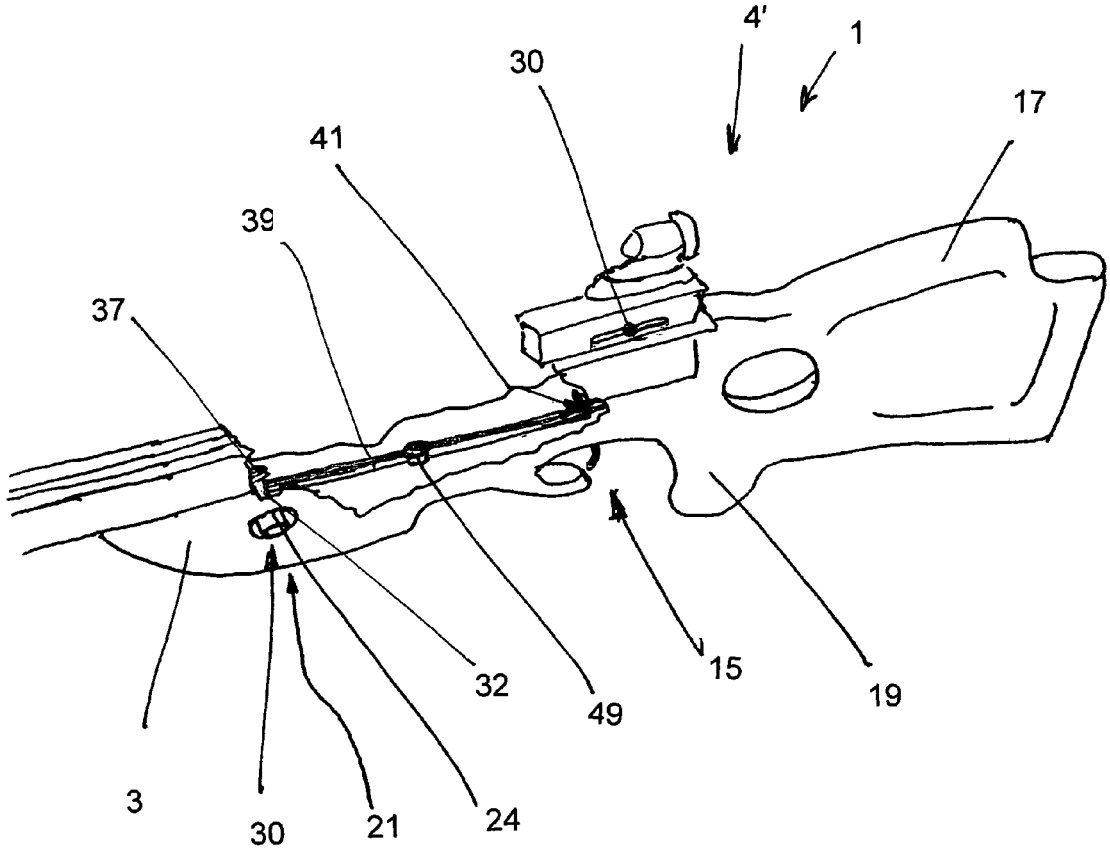
FIG. 3 is a picture of a crossbow having a stock safety device.

With reference again to FIGS. 1 and 2 and now to FIG. 3, the crossbow 1 may include a safety 30 for use in preventing the trigger mechanism 15 from engaging and thus from preventing discharge of the crossbow 1 when the bowstring 11 is drawn back. The safety 30 may be a mechanical safety interconnected to the trigger mechanism 15 such that when the safety 30 is engaged the trigger mechanism 11 cannot be operated, which prevents the crossbow 1 from being fired as previously discussed. In other words, when the safety 30 is engaged the trigger mechanism 15 cannot be pulled back or fired. The safety 30 may be configured in any manner chosen with sound engineering judgment. In one embodiment, the safety 30, when engaged, prevents the trigger mechanism 15 from firing by placing a mechanical block into the path of the trigger mechanism 15 thereby preventing the trigger mechanism 15 from moving and thereby preventing the crossbow 1 from firing.

With reference to FIGS. 1 through 3, the crossbow 1 may also include a safety mechanism 21 for preventing the crossbow from firing when the operator appendages are in the path of the traveling projectile. In one embodiment, the safety mechanism 21 may be a stock safety mechanism or stock safety 21. The stock safety 21 may include a first push button 24 mounted proximate to the position where the associated operator would grasp the stock 3 of the crossbow 1 during operation. In this manner, the crossbow 1 may only be fired when the stock safety button 24 is depressed. Since depressing the button 24 requires the use of the operator's thumb, and/or fingers on the opposing side of the stock, to apply pressure to the button 24, the crossbow may only be fired when the thumb and/or finger is in contact with the button 24. In that the button 24 is disposed on the stock 3 and below the path of travel of the bowstring, the bowstring cannot cause injury to the thumb and/or fingers thus providing a safety mechanism that prevents injury to the hand grasping the stock of the crossbow 1. It is noted here that a firm grip on the stock 3 of the crossbow 1 is needed to properly fire the crossbow. Thus, the safety mechanism 21 would allow the operator to properly grasp the stock 3 while engaging the safety mechanism 21. The position of the stock safety 21 may reside on the either side of the stock depending on the handedness of the associated operator. In other words, the stock safety 21 may be configured for either a left-handed or a right-handed operator. In an alternate embodiment, the stock safety 21 may include first 24 and second 24' buttons, wherein the buttons 24, 24' reside one on each side of the stock 3 respectively. In this manner, the stock safety 21 may require the operator to depress the first button 24 with the operator's thumb, for example and to depress the second button 24' with the operator's fingers simultaneously to disengage the stock safety 21 for discharging the crossbow 1. It is noted that the stock safety 21 is normally engaged or biased in a default position to prevent firing of the crossbow. That is to say that when the crossbow 1 is set down after use, the safety mechanism 21 is biased to automatically engage thus preventing the trigger mechanism from moving. It is also noted here that the safety mechanism 21 works in conjunction with the safety 30. Both safeties must be disengaged for the crossbow 1 to be fired.

Figure 4:
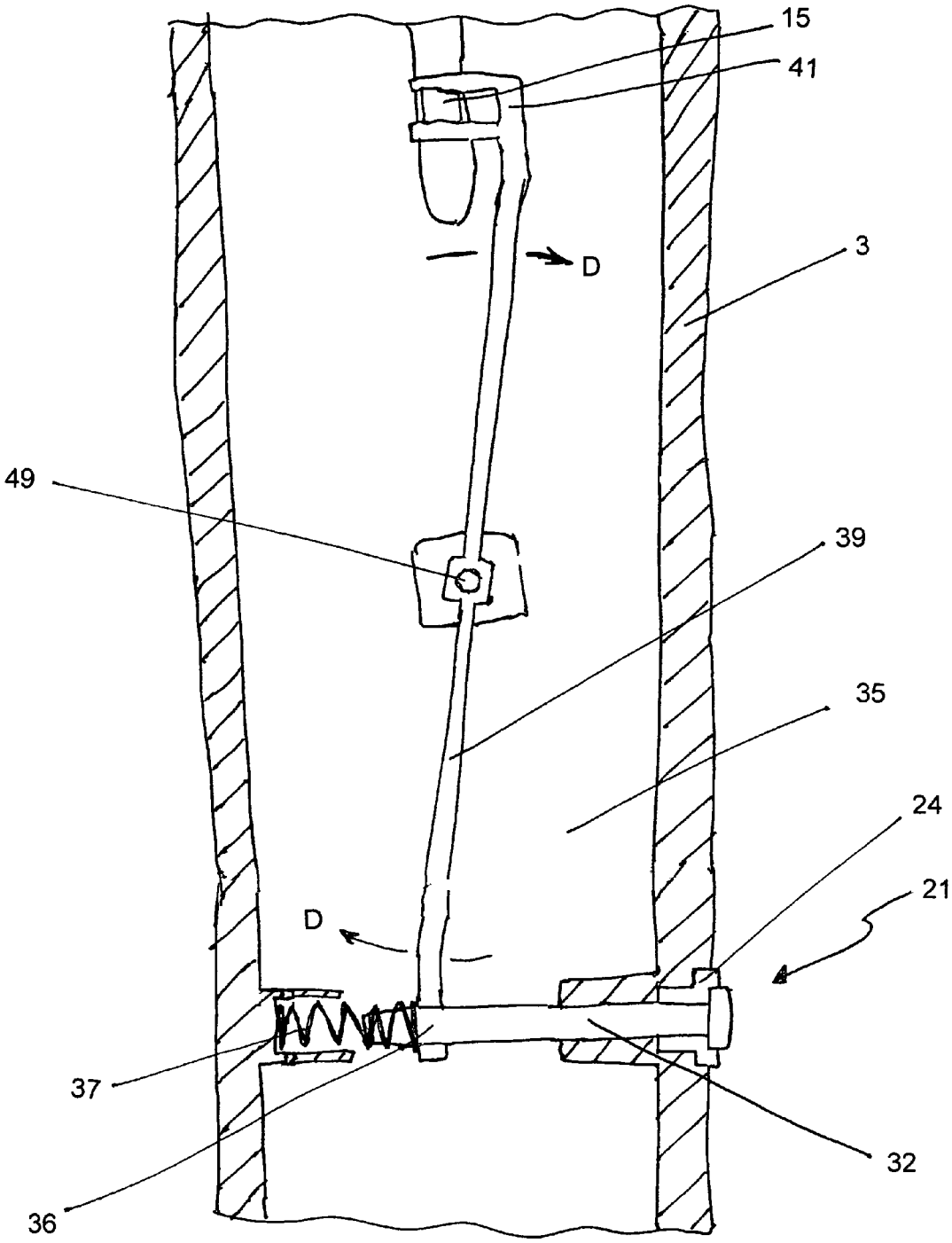
FIG. 4 is a partial cutaway top view of the stock of a crossbow having a stock safety device.

With continued reference to FIGS. 1 through 3 and now to FIG. 4, the push button 24 may be disposed within the stock 3 of the crossbow 1 and extended to the exterior of the stock 3 for access by the operator. On the inside of the stock 3, the push button 24 may be connected to a rod member 32. The first end 36 of the rod member 32 may contact biasing means 37, which may be a spring 37, for use in biasing the push button 24 into a default position. Any type of biasing means may be chosen with sound engineering judgment as is appropriate for use with the present invention. In this manner, when the operator releases the push button 24, the rod member 37 and the push button 24 return to a default safety state as biased by the spring 37. A rigid linkage member 39 may also be included that is fixedly connected to the rod member 32 at a first end of the linkage member 39. The distal end of the rigid linkage member 39 may include a bifurcated portion 41 that may engage the trigger mechanism 15. The bifurcated portion 41 may be integrally formed with linkage member 39. However, any configuration of linkage member 39 and bifurcated portion 41 may be chosen with sound engineering judgment. Accordingly, the entire linkage member 39 may be pivotally connected with respect to the body of the stock 3, thereby allowing the linkage member 39 and the bifurcated portion 41 to pivot into and out of engagement with the trigger mechanism 15, as shown in FIG. 4. It is noted here that the linkage member 39 may pivot about a fixed point 49 within the stock 3 but may not move otherwise. Any manner of allowing the linkage member 39 to pivot without otherwise translating may be chosen with sound engineering judgment. When the operator depresses the push button 24, thus overcoming the force of the biasing means 37, the rod member 32 may pivot the linkage member 39 and more specifically the bifurcated end 41 of the linkage member 39 out of engagement with the trigger 15. Therefore, the stock safety 21 is normally engaged, and must be intentionally disengaged in order to pull the trigger mechanism 15 thus firing the crossbow 1. It should be emphasized that the present embodiment discusses a mechanical safety mechanism 21 including a mechanical linkage member 39. However, it is noted that any assembly and/or configuration of linkage members, including but not limited to mechanical, electrical, electromagnetic, and the like may be chosen with sound engineering judgment.

Figure 5:
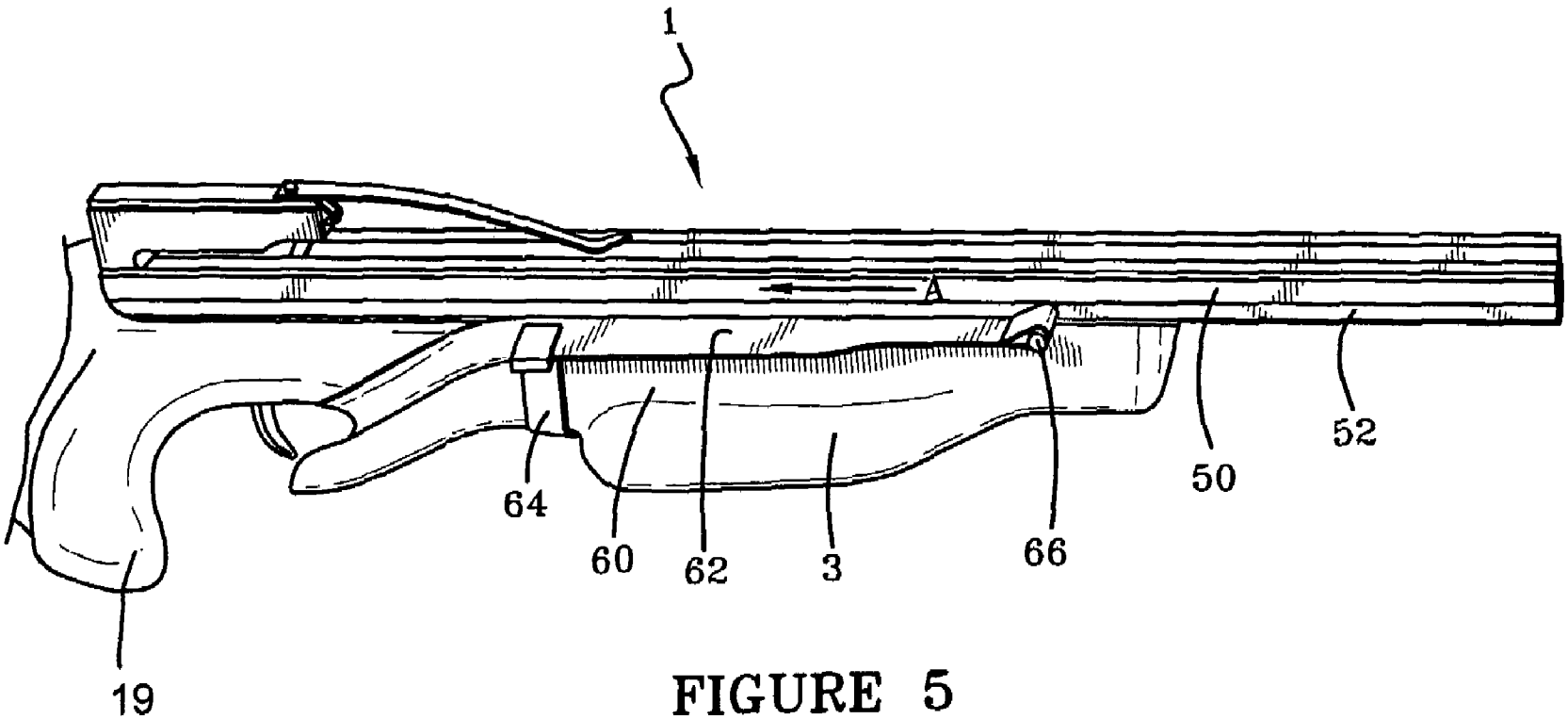
FIG. 5 is a side view of a crossbow showing the crossbow grip guard retro-fitted to an existing crossbow.
Figure 6:
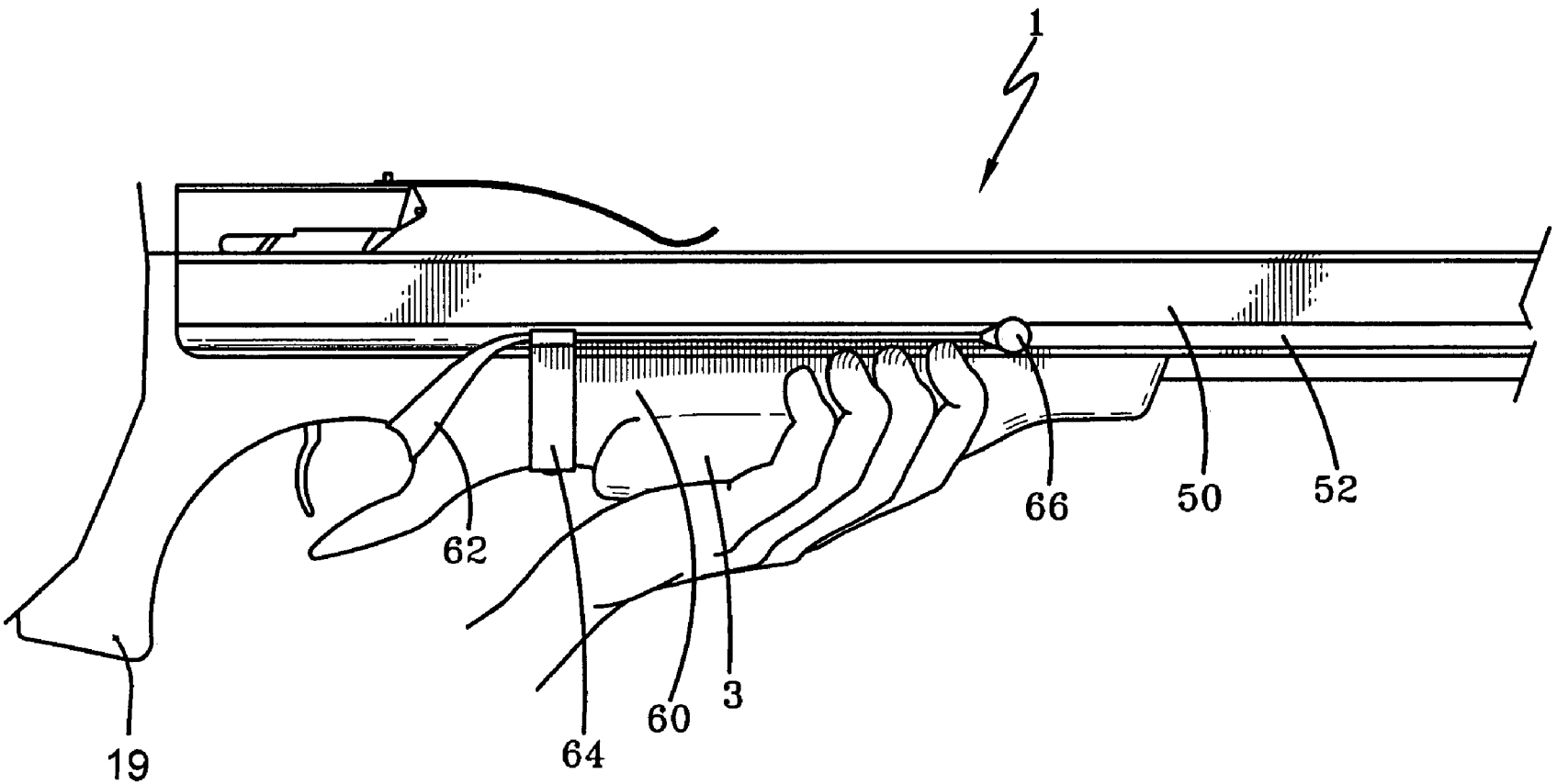
FIG. 6 is a side view of a crossbow having the crossbow grip guard.

With reference to FIGS. 5 and 6, a grip guard 60 is shown. The grip guard 60 has an outwardly extending member 62. The outwardly extending member 62 extends outwardly perpendicular to the stock 3 and a barrel 50 of the crossbow 1. The outwardly extending member 62 need not be exactly perpendicular to a longitudinal axis of the barrel 50 or stock 3. The grip guard 60 may also have a locking member 64 that secures the outwardly extending member 62 to the stock 3. The need for the locking member 64 would be where the grip guard 60 is retro-fitted to an existing crossbow 1. In that case, there is also an axis 66 that slides within the opening 52 of the barrel 50. The outwardly extending member 62 is secured to the axis 66. The axis 66 is secured in place by the force of the outwardly extending member 62 pulling in a direction toward the butt (not shown) of the crossbow 1. This force is shown in FIG. 5 in the direction of arrow A. Locking member 64 engages outwardly extending member 62 to ensure that it in fact stays outward (i.e., perpendicular). The outwardly extending member 62 is typically made of sheet metal, however, it can be made of any material which accomplishes the objective of extending the outwardly extending member 62. The locking member 64 travels across to the other side of the crossbow 1, which is a mirror image of the side shown in FIGS. 5, 6. The outwardly extending member 62 extends around, under and through the grip 19 as shown within FIGS. 5, 6. It is typically made of one solid piece of material, such as rubber, however, any material accomplishing the intended function of the outwardly extending member 62 is within the scope of this invention, including multiple, separate pieces.

The objective of the grip guard is to keep the operator's fingers below the bolt path. The grip guard ensures that this should be avoided by making it an obstacle for an operator's fingers to extend over the grip guard 60 and onto the path of a bolt. The grip guard also serves as a tactical reminder of the proper hand position for gripping a crossbow. Therefore, any means that accomplishes that end result is within the scope of the grip guard.

Figure 7:
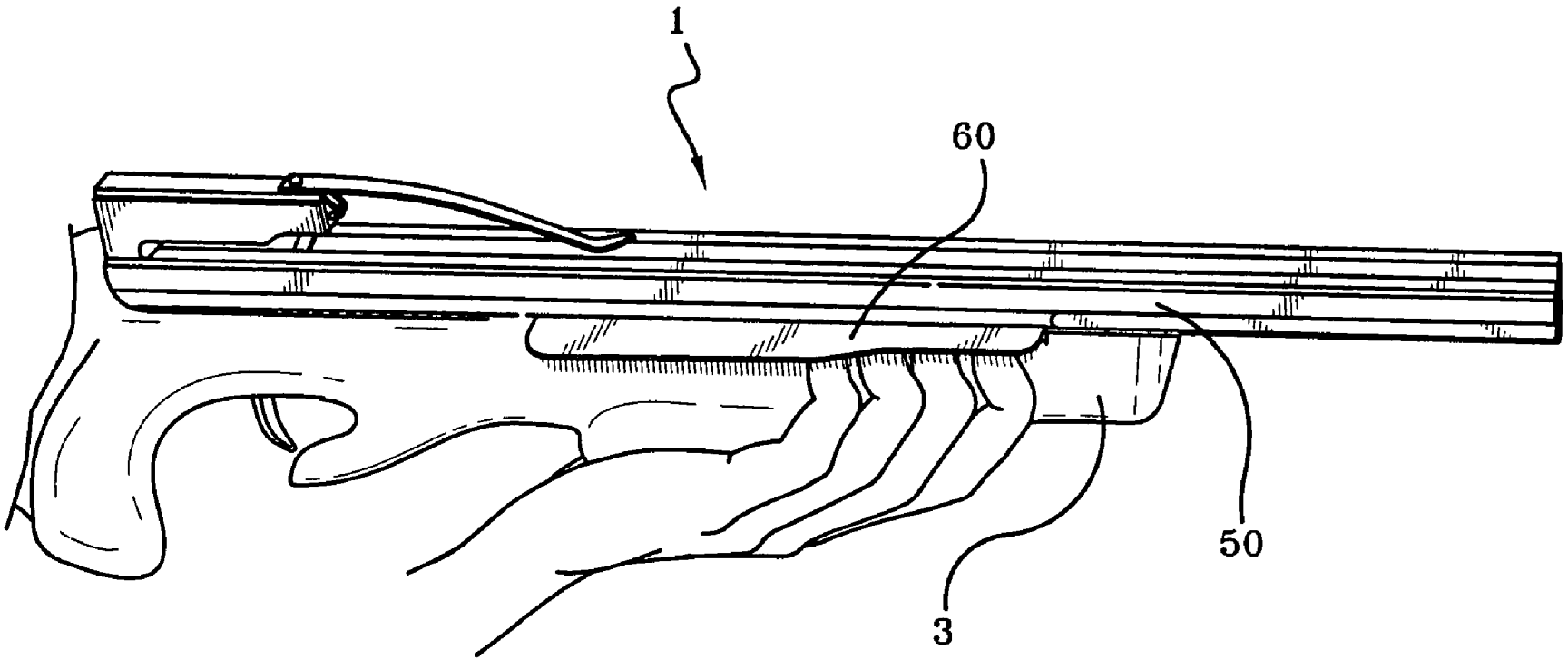
FIG. 7 is a view of a crossbow where the crossbow grip guard is molded into the stock.
Figure 7A:
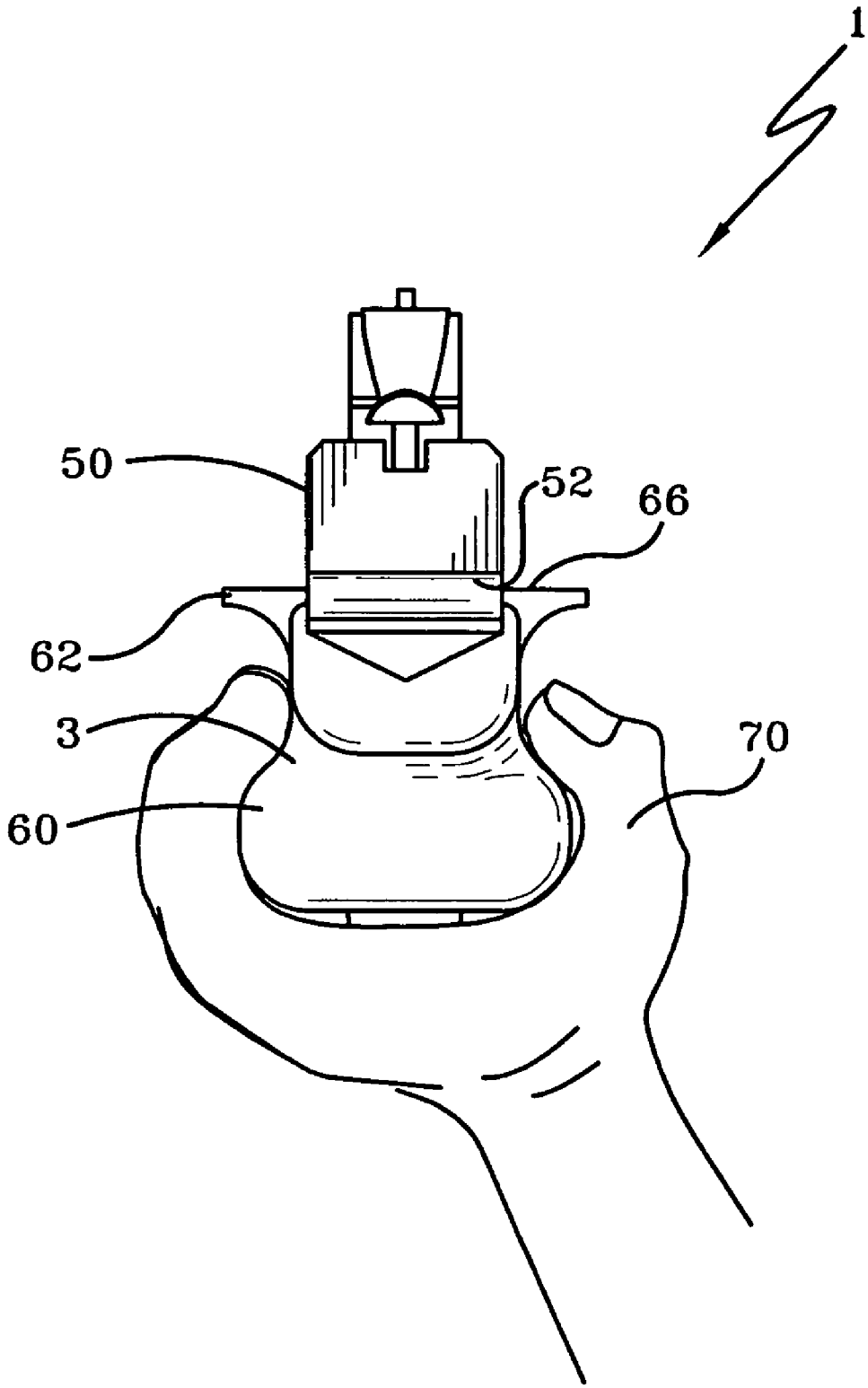
FIG. 7A is an end view of a crossbow having the crossbow grip guard molded into the stock.

FIG. 7 shows that the grip guard 60 may also be molded within the crossbow 1. The molded grip guard 60 could be molded within the stock 3 and extend outwardly of the barrel 50. With respect to FIG. 7A, the grip guard 60 is shown from an end view. The outwardly extending member 62 is molded within the stock 3. A normal user's hand 70 is shown in FIG. 7A. Outwardly extending member 62 extends outwardly from the stock 3 such that the user's hand 70 would not extend above outwardly extending member 62. While it is possible for larger hand 70 to be able to extend beyond extending member 62, it would be difficult and awkward for such occurrence.

Figure 8:
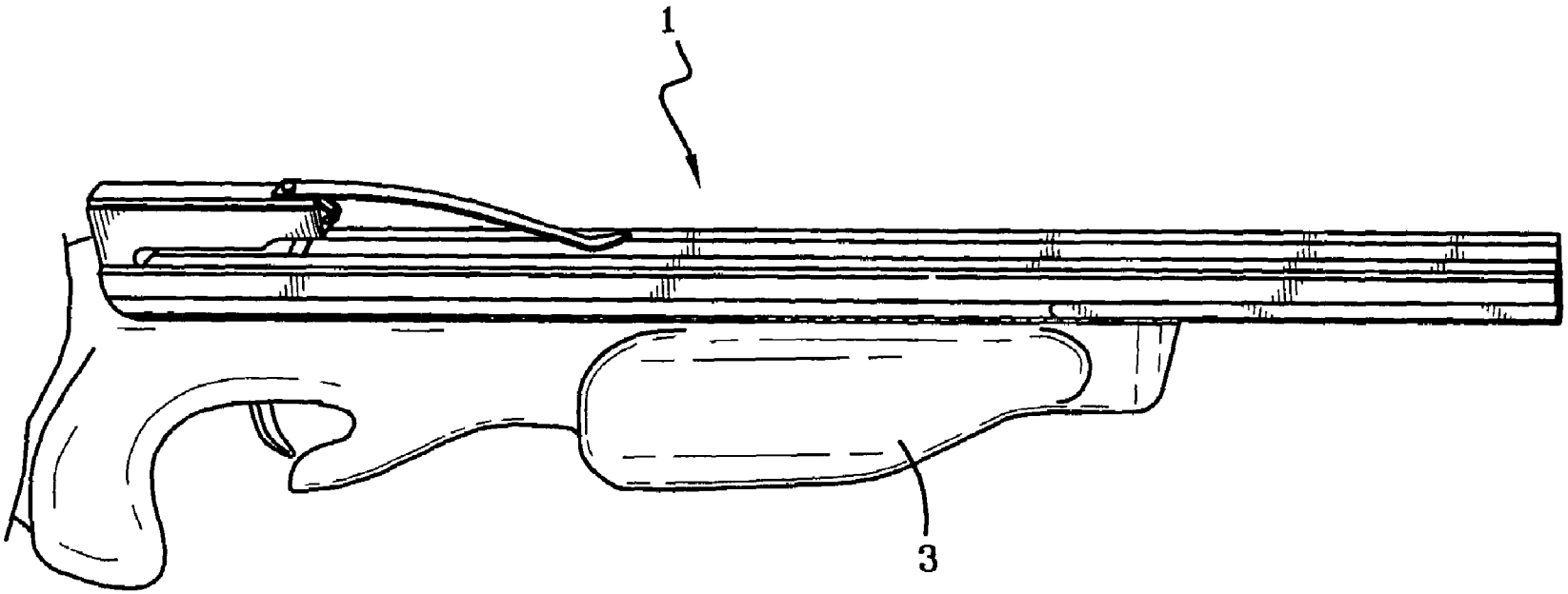
FIG. 8 is a side view of a crossbow having an enlarged stock such that a normal user's fingers are unable to reach into the bolt path.
Figure 8A:
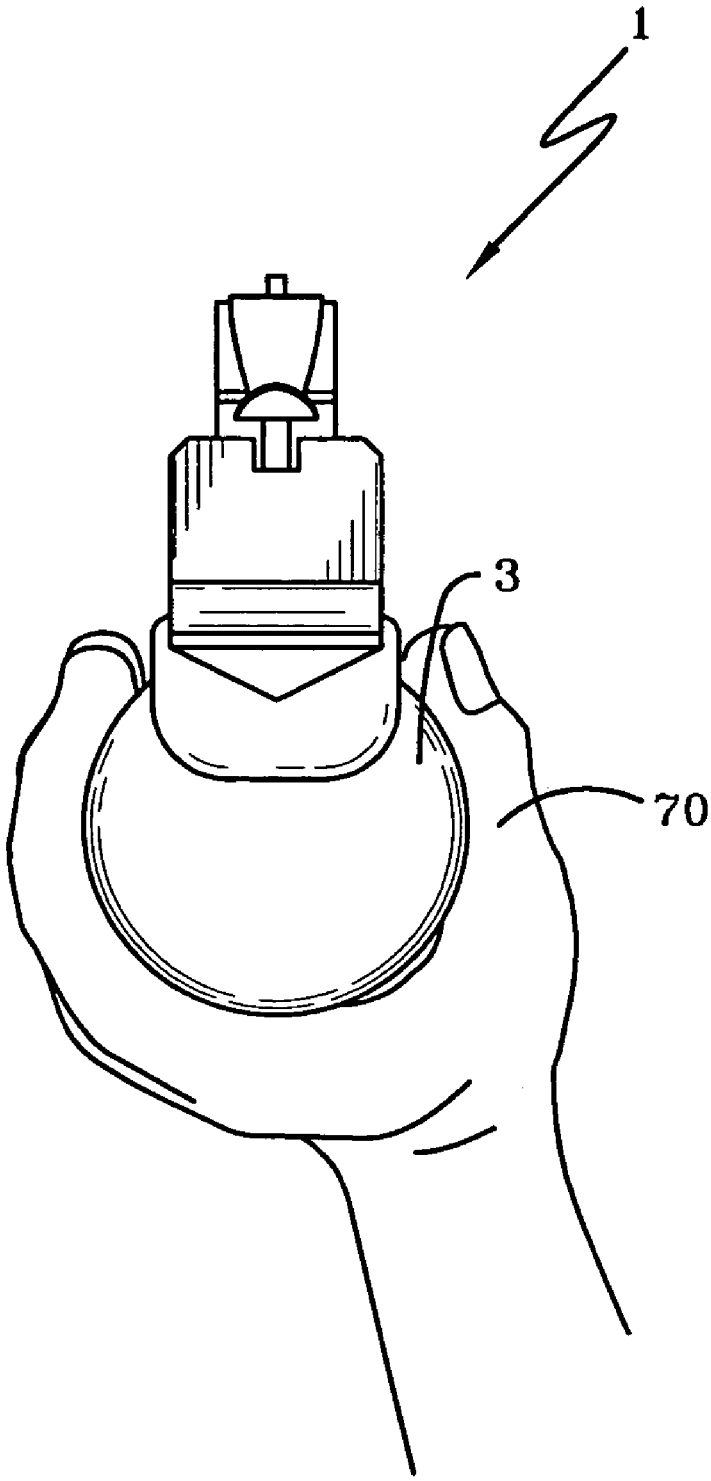
FIG. 8A is an end view of a crossbow having an enlarged crossbow stock.

Turning now to FIGS. 8 and 8A, an elongated or oversized stock 3 such that an operator's hand (i.e., fingers) would either be unable to reach the bolt path or otherwise make it uncomfortable is shown. FIG. 8 shows an enlarged stock 3 without an outwardly extending grip guard. The enlarged stock 3 is enlarged enough such that a normal-size hand/finger would be unable to reach the bolt path. An end view shown in FIG. 8A shows the enlarged stock 3 being gripped by a normal-sized hand 70. Obviously, a user who has abnormally-sized large hands and fingers may be able to circumvent the grip guard of the enlarged stock 3; however, not without the deterrence of the enlarged stock 3 or being very uncomfortable.

An oversized crossbow stock embodiment is directed to a circular crossbow stock, wherein at least a cross-sectional portion of the stock that is perpendicular to the longitudinal axis of the crossbow barrel as an outer circumference length ranging from about 5 to 8 inches. In another embodiment, the cross-sectional portion of the stock that is perpendicular to the longitudinal axis of the crossbow barrel has an outer circumference length of about 5¼ inches.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

Having thus described the invention, it is now claimed:

We claim:

1. A crossbow comprising:

a crossbow grip guard having a member that extends outwardly in a direction that is substantially perpendicular to a stock, and wherein the member extends for a length in a direction that is substantially parallel to the longitudinal axis of a crossbow barrel or stock, wherein the grip guard further comprises a locking member that secures the outwardly extending member to the stock; and, a first axis that is positioned within an opening of the crossbow barrel in a direction that is substantially perpendicular to the longitudinal axis of the crossbow barrel and wherein the first axis is secured to the outwardly extending member.

2. A crossbow comprising:

a crossbow grip guard having a member that extends outwardly beyond the surface of a stock in a direction that is substantially perpendicular to the stock and substantially parallel to a first axis defined by a first and second end of a crossbar, and wherein the member extends for a length in a direction that is substantially parallel to the longitudinal axis of a crossbow barrel or stock, wherein the grip guard is molded within the stock.

* * * * *